United States Patent [19]

Kopp

[11] Patent Number: 4,501,078

[45] Date of Patent: Feb. 26, 1985

[54] SKIING BOOT

[75] Inventor: Ernst Kopp, Graz, Austria

[73] Assignee: Skischuhfabrik Dynafit Gesellschaft m.b.H., Graz, Austria

[21] Appl. No.: 423,742

[22] Filed: Sep. 27, 1982

[30] Foreign Application Priority Data

Sep. 30, 1981 [AT] Austria ..... 4189/81

[51] Int. Cl.[3] ..... A43B 5/04

[52] U.S. Cl. ..... 36/121

[58] Field of Search ..... 36/117–121, 36/105

[56] References Cited

U.S. PATENT DOCUMENTS 3,619,914 11/1971 Hanson et al. .
4,349,971 9/1982 Everest, III ..... 36/121
4,404,758 9/1983 Kopp ..... 36/121

FOREIGN PATENT DOCUMENTS 1922563 8/1970 Fed. Rep. of Germany .
2057094 5/1972 Fed. Rep. of Germany .
2341283 9/1977 France .

OTHER PUBLICATIONS

Prospect "Dachstein Skichuke Collection", 1979/80 of Company Dachstein.

*Primary Examiner*—James Kee Chi
*Attorney, Agent, or Firm*—Fleit, Jacobson, Cohn & Price

[57] ABSTRACT

A skiing boot comprises a gaiter, which is pivotally movable relative to the foot part, and a spring element, which is disposed between the foot part and the gaiter and under an adjustable initial stress. The spring element influences the movement of the gaiter relative to the foot part in the direction of skiing. Mutually independent means are provided for adjusting the initial stress of the spring element and for adjusting the forward lean of the gaiter relative to the foot part. A releasable adjusting device for fixing the inclination of the gaiter is provided between the foot part and the gaiter.

9 Claims, 8 Drawing Figures

FIG. 2
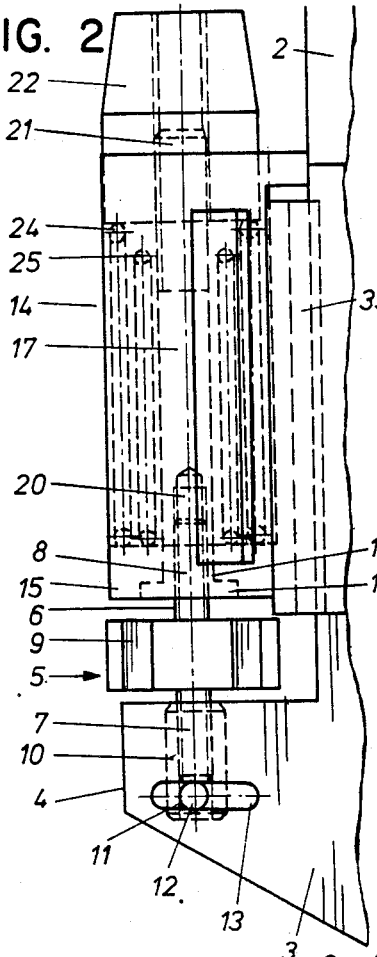
FIG. 3
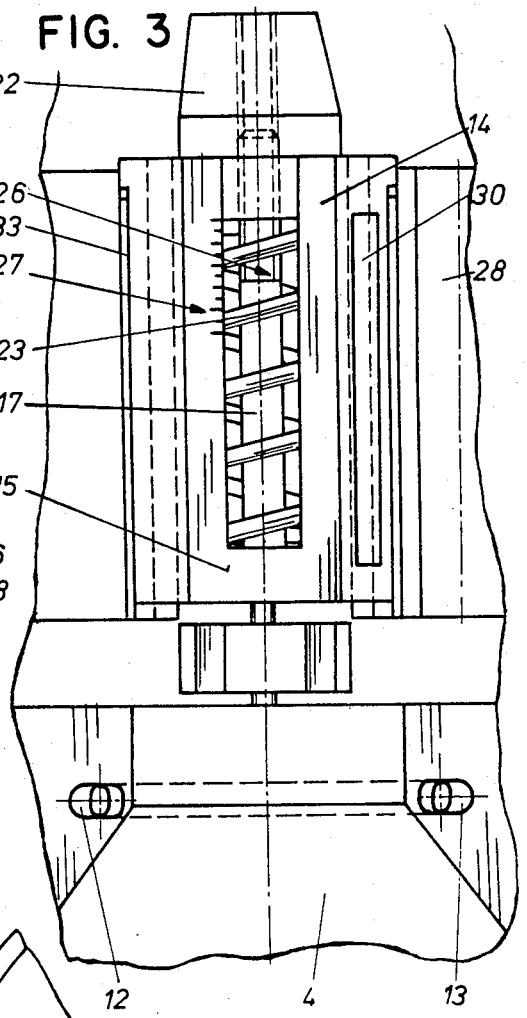
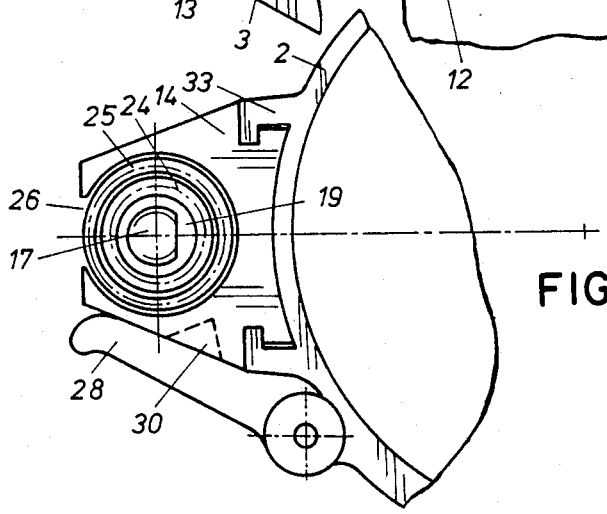
FIG. 4

FIG. 6
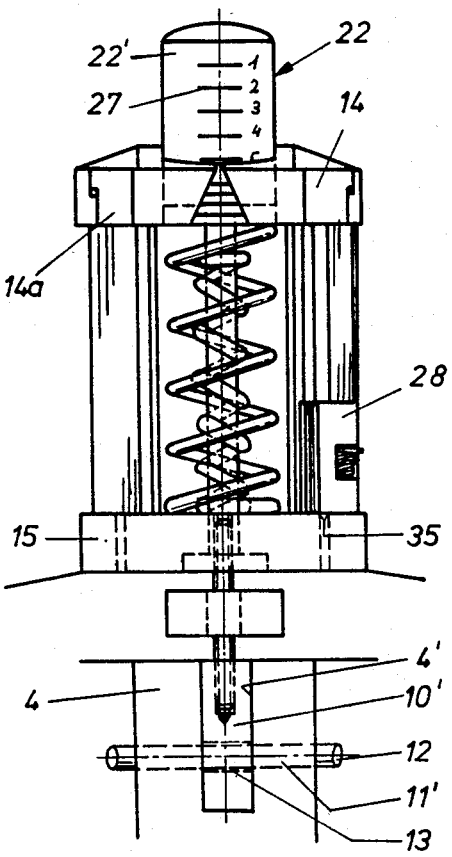
FIG. 8
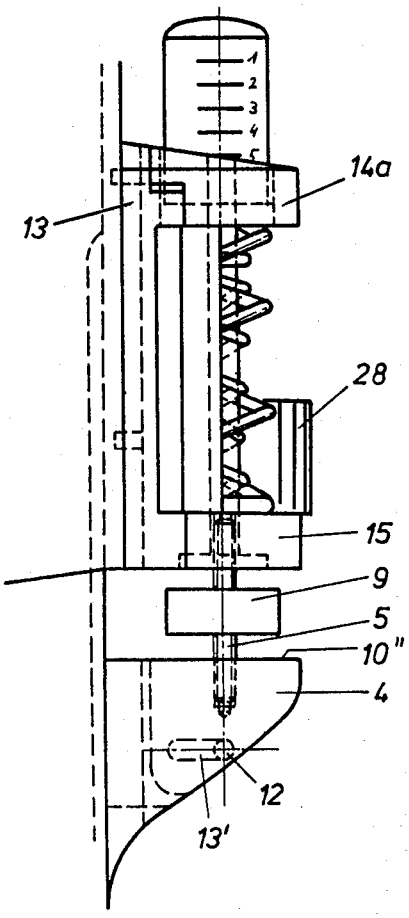
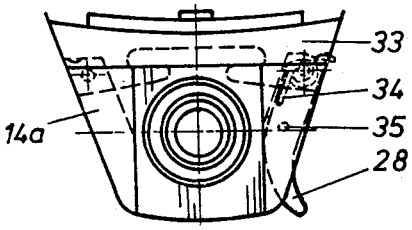
FIG. 7

SKIING BOOT

SUMMARY OF INVENTION

A skiing boot comprising a gaiter, which is pivotally movable relative to the foot part. A releasable adjusting device for fixing the inclination of the gaiter relative to the foot part is provided between the foot part and the gaiter. Spring means are provided, which permit a further bending forward of the gaiter against the force of the spring means.

This invention relates to a skiing boot comprising a gaiter, which is pivotally movable relative to the foot part of the skiing boot.

In skiing boots made of plastic material, the foot part of the boot consists usually of a single part, which is relatively rigid, and the boot comprises a gaiter, which is also stiff and surrounds the ankle and corresponds to the leg of the boot and is pivotally movable relative to the foot part on an axis disposed at or near the center of the ankle. Particularly racers do not desire a gaiter which can be pivotally moved freely relative to the foot part but a gaiter is desired which is held relative to the foot part as rigidly as possible in a position which corresponds approximately to the squatting position assumed by the skier, e.g., during a downhill run. On the other hand, the gaiter should yield as the skier traverses uneven portions of the slope or small humps and the like and should be able to be bent forwardly so that the resulting shocks can be taken up by the knees of the skier. But whereas walking is difficult in any case for a person wearing skiing boots because the sole is stiff, gaiters which are movable only with difficulty virtually prevent any walking.

For this reason it is an object of the invention to eliminate these disadvantages of the known skiing boots which consists of a foot part and a pivoted gaiter and to provide a skiing boot in which the gaiter can be adjusted to a predetermined inclination relative to the foot part of the boot, the gaiter can be bent forward further against the action of a restoring force, and the gaiter is also capable of an unrestrained pivotal movement relative to the foot part.

In a skiing boot of the kind described first hereinbefore, these objects are accomplished in accordance with the invention in that a releasable adjusting device for adjusting a minimum inclination of the gaiter relative to the foot part is provided between the foot part and the gaiter.

Further features of the invention will now be explained with reference to the drawings, which show an illustrative embodiment to which the invention is not restricted in any way.

Figure 1:
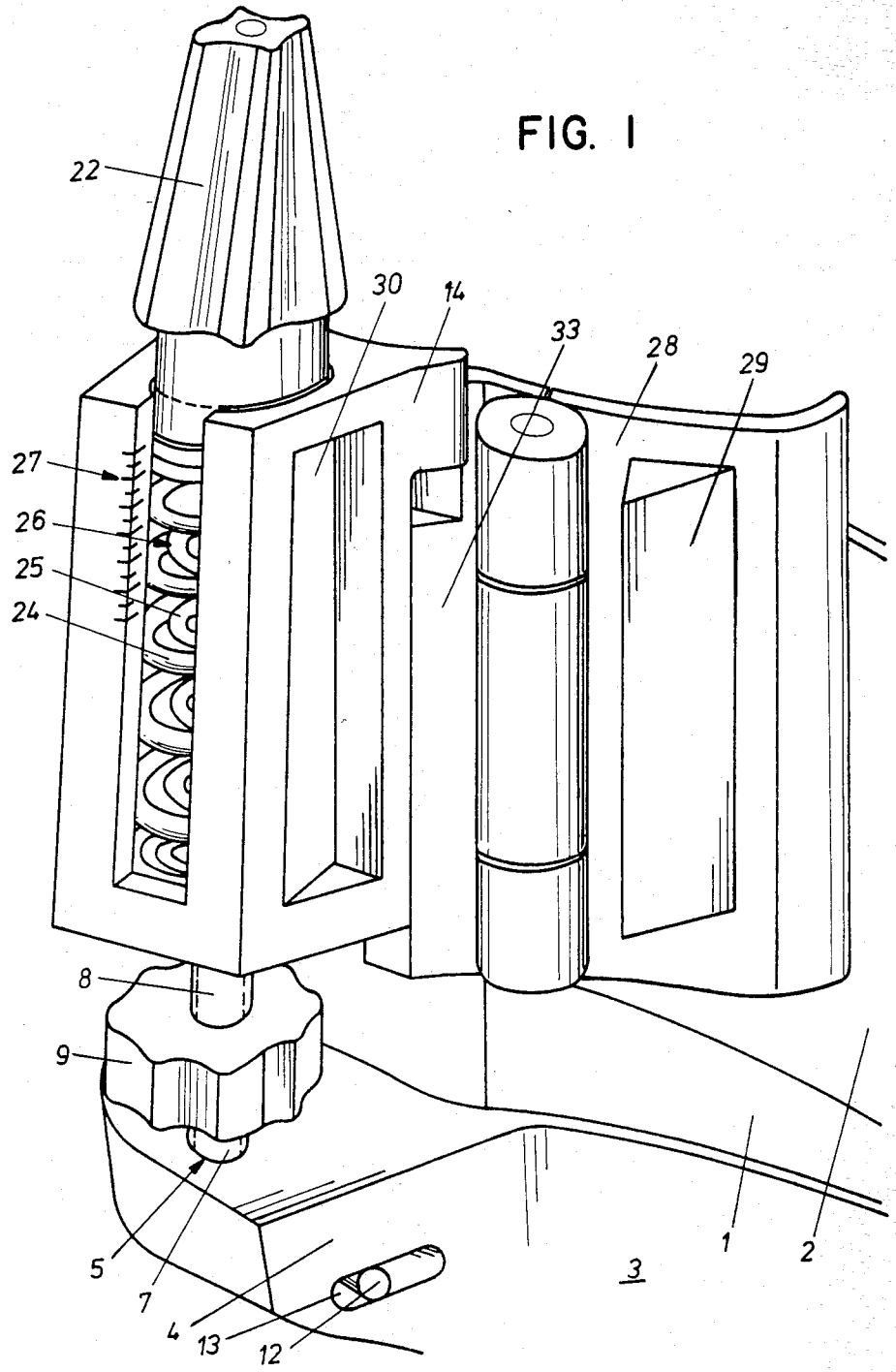
Figure 5:
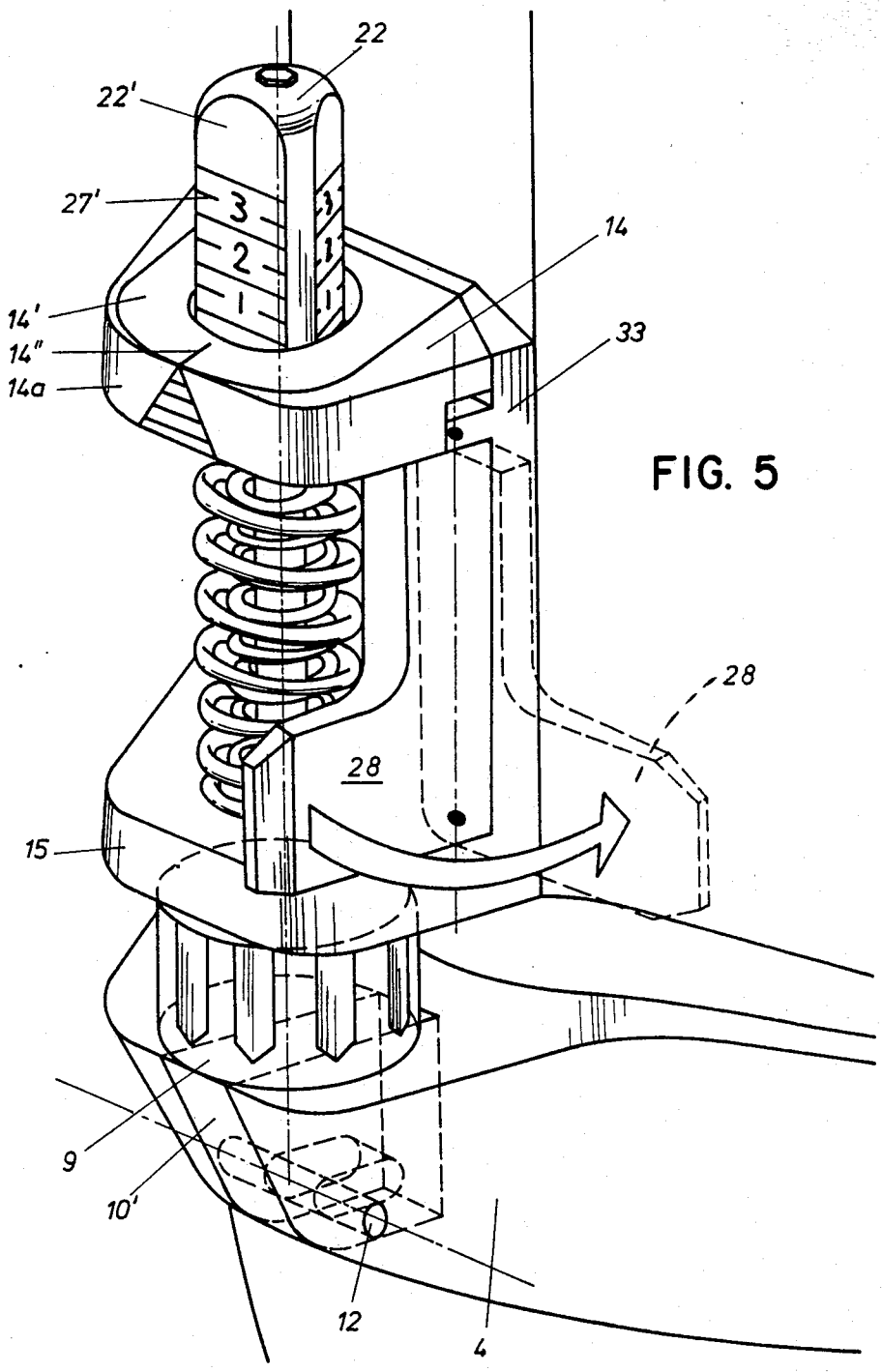

FIG. 1 is a perspective view showing the heel portion of a skiing boot with an adjusting device, FIG. 2 is a side elevation, FIG. 3 is a rear elevation, FIG. 4 is a top plan view showing the adjusting device, FIG. 5 is a perspective view showing a different embodiment, FIG. 6 is an elevation showing that embodiment, FIG. 7 is a top plan view and FIG. 8 a side elevation.

The boot shown in FIG. 1 has a foot part 1 and a gaiter 2, which is pivoted to the foot part 1 by means which are not shown. An extension 4 extends rearwardly from the heel portion 3 of the foot part 1 and serves as a mounting for an adjusting screw 5. As is more clearly apparent from FIG. 2, the adjusting screw 5 has a shank 6, which has mutually opposite end portions 7, 8 provided with oppositely handed screw threads, one of which is right-hand thread and the other a left-hand one. The adjusting screw 5 is provided in the middle with a knurled wheel 9. The lower end 7 of the screw 5 is in threaded engagement with female screw threads of a tapped sleeve 10, which is held with backlash in a suitable opening in the extension 4. The tapped sleeve 10 is provided near its lower end with a transverse bore 11, in which a retaining rod 12 is fitted, which extends also through a transverse slot 13 in the extension 4. It is apparent that the tapped sleeve 10 is held in the extension 4 against rotation and against axial displacement but can be slightly inclined.

The gaiter 2 is provided on its heel portion with a dovetail guide 33, by which a slider 14 is held, which can be moved up and down. The slider 14 has substantially the shape of a hollow prism, which has a bottom 15 formed with a bore 16, through which a bolt 17 extends, which is provided at its lower end with a flange 18. In the embodiment shown by way of example, the bottom 15 is formed on its outside (underside) with a recess for receiving the flange 18. To prevent a rotation of the bolt 17 relative to the slider 14, the bolt 17 has a flat 19, which extends from the flange 18 and may extend throughout the length of the bolt 17 (FIG. 4). The bore 16 has a similar non-circular shape in cross-section so that the bolt 17 cannot rotate relative to the slider 14 but can be axially moved out of and into the slider 14. At its flanged end, the bolt 17 has female screw threads 20, which are in threaded engagement with the upper end portion 8 of the adjusting screw 5.

The upper end of the bolt 17 is provided with male screw threads 21 in threaded engagement with an adjusting nut 22. The underside of the nut 22 constitutes an abutment for a spring arrangement 23, which at its other end bears on the bottom 15 of the slider 14. In the embodiment shown by way of example, the spring arrangement 23 consists of two helical compression springs 24, 25, which extend one in the other and surround the bolt 17. A non-linear ("progressive") spring characteristic is obtained because the two springs 24, 25 differ in length. The shorter spring 25 will not become effective until the longer spring 24 has been compressed to some extent.

To provide a measure for the initial stress to which the spring arrangement 23, particularly the longer spring 24, has been adjusted by means of the adjusting nut 22 and to permit an adjustment of a predetermined initial stress, a graduated scale 27 may be provided at the edge of a longitudinal slot 26 in the rear wall of the slider 14 and the lower edge of the nut 22 may constitute a pointer which is associated with said scale.

The slider 14 is detachably connected to the gaiter 2 by a coupling plate 28, which is hinged to the gaiter 2 beside the guide 33. The hinged plate 28 is provided with a rib 29 or another projection, which exactly fits a mating recess 30 in that side wall of the slider 14 which is nearest to the hinged plate 28. In the position shown in FIG. 1, the hinged plate 28 has been swung off so that the gaiter 2 is freely movable relative to the slider 14 and the wearer of the skiing boot can walk.

When the hinged plate 28 has been swung against the slider 14 so that the rib 29 enters the recess 30, the position of the gaiter will be determined by the adjustment of the slider (position for downhill runs).

The arrangement which has been described is used as follows:

When the skier intends to walk, all that is required is to turn the hinged plate 28 of each skiing boot to the position shown in FIG. 1. As a result, the gaiter 2 is separated from the slider 14 and can be freely pivotally moved in accordance with the motion of the lower leg.

For a downhill run, the hinged plate 28 must be moved to the position shown in FIG. 4 so that the rib 29 snaps into the recess 30 and the slider 14 is now rigidly connected to the gaiter 2. The knurled wheel 9 can now be rotated to adjust the gaiter 2 relative to the foot part 1 to that angular position or inclination which the skier has found to be appropriate and comfortable by experience. The initial stress of the spring arrangement 23 is adjusted by a rotation of the adjusting nut 22. This adjustment may be made by trial and error in that the skier squats to ascertain the resistance to the pivotal movement of the gaiter and adjusts the initial stress accordingly. With reference to the scale 27, an initial stress which has previously been found to be desirable can be repeatedly selected, also with different boots of the same kind.

As the knurled nut 9 is rotated, the slider 14 is raised or lowered so that the inclination of the gaiter is changed. In the prior art, the adjustment of the slider 14 alters also the spring damping. In the present embodiment, the spring damping is not changed by an adjustment of the slider 14 because the nut is raised or lowered together with the adjusting element so that the initial stress of the spring is not changed. As a result, the inclination can be adjusted without a change of the damping. When the plate 28 has been swung out so that the portion 29 has left the groove 40, the turning of the plate 28 to its closed position will restore the original position unless the knurled nut has been turned.

The embodiment shown by way of example can be modified in various ways. For instance, the two springs 24, 25 can be replaced by three or more springs. The arrangement of the rib 29 and the recess 30 may be inverted in that the slider 14 is provided with a recess and an aperture or recess is provided in the hinged plate 28. The hinged plate may be biased by an overcenter spring for holding the hinged plate in its coupling position and in the position in which the slider 14 is released. Two hinged plates may be provided on opposite sides of the slider 14. The bolt 17 may be held against rotation by means other than those described, e.g. by a longitudinal groove in the bolt and a projection, rib or the like which is provided in the bore 16 and extends into said groove.

In the embodiment shown in FIGS. 5 to 8, those parts which are included also in the previously described embodiment are designated with the same reference characters. The following parts and subassemblies differ.

The adjusting nut 22 has an upper or outer portion consisting of a three cornered (or more-cornered) prism. Each side face 22' is provided with a graduated scale 27'. A pointer associated with these scales 27' is constituted by a mark 14'' at the top edge 14' of the slider 14.

The slider 14 is substantially open and may have the configuration of a C. The upper leg **14*a* is provided with the mark 14''. The lower leg constitutes the bottom 15 of the slider. The web is again provided with the plate 28, which is hinged at the guide 33 and has such a height that it can be inserted between the two legs 14*a* and 15 of the slider 14 to couple the latter. In this embodiment, the hinged plate 28 has no projection 29, as in the first embodiment and is biased by a spring 34 toward the released position. A catch 35 retains the hinged plate 28 in the swung-in or coupling position against the force of the spring 34**.

The tapped sleeve 10 has the shape of a low prism 10' having a base in the shape of an isosceles right-angled triangle. That prism has a surface 10'', which extends from one of the legs of the triangle and is formed with a tapped blind bore in threaded engagement with the lower portion of the adjusting screw 5. A transverse slot 13' extends in the prism across that blind bore and receives the retaining rod 12. The extension 4 is formed with a vertical slot 4', which is defined by two parallel side walls and accommodates the prismatic tapped sleeve. The extension 4 has two aligned bores 11', which extend through the just mentioned side walls and receive the retaining rod 12.

The embodiment shown in FIGS. 5 and 8 has also a different spring arrangement. The two helical compression springs 24, 25 extend one in the other and differ in hand and lead so that they will not interfere with each other as convolutions of one spring cannot enter between convolutions of the other spring.

What is claimed is:

1. A skiing boot comprising:

a foot part, a gaiter pivotably mounted on the foot part, a slider slidably mounted on the gaiter, an adjustable spring means cooperating with the slider for exerting a force opposing a bending forward movement of the gaiter;

a releasable coupling means for coupling the gaiter and slider, means for adjusting the stress on the adjustable spring means, and means interconnecting the slider and the foot part for adjusting the inclination of the gaiter relative to the foot part, the inclination of the gaiter relative to the foot part being adjustable independent of the stress on the adjustable spring means and the stress on the adjustable spring means being adjustable independent of the inclination of the gaiter relative to the foot part when the releasable coupling means couples the slider and the gaiter in a coupling position.

2. A skiing boot according to claim 1, characterized in that the means interconnecting the slider and the foot part comprises an adjusting screw which has oppositely handed screw threads at opposite ends and a knurled wheel and said adjusting screw being connected at one end to a heel portion of the foot part and at the other end to said slider, said slider being guided on a heel portion of the gaiter.

3. A skiing boot according to claim 2, characterized in that the heel portion of said foot part is provided with a rearward extension, which receives a tapped sleeve in threaded engagement with one end of the screw, said tapped sleeve is formed with a transverse bore, said extension is formed with a transverse slot, a retaining rod extends through said transverse bore and said transverse slot, and said tapped sleeve has the shape of a low prism and is formed with a blind tapped bore and with a slot for receiving said retaining rod.

4. A skiing boot according to claim 2, characterized in that said slider consists of a hollow prismatic body, which has a bottom formed with a bore.

5. A skiing boot according to claim 2, characterized in that the slider is C-shaped, the lower leg of the slider is formed with a bore, a bolt extends through said bore in said lower leg and is axially movable and held in said slider against rotation and its end portion extending through said bore in said lower leg has female screw threads in threaded engagement with the other end of said screw, said bolt is provided at its other end with screw threads in threaded engagement with an adjusting nut, a spring arrangement is provided between said adjusting nut and the lower leg of the slider, said bolt is provided at its lower end with a flange that bears on the outside surface of said lower leg, said bolt and said bore have a surface each which is parallel to the axis, and said surfaces cooperate to prevent a rotation of said bolt relative to said slider.

6. A skiing boot according to claim 2, characterized in that said slider has a longitudinal slot, a graduated scale which is associated with an adjusting nut is provided at the edge of said longitudinal slot, and a spring arrangement is provided between said adjusting nut and the bottom of said slider and consists of two springs, which extend one in the other and differ in length and have opposite hands and different leads.

7. A skiing boot according to claim 2, characterized in that said releasable coupling means includes a side wall of said slider defining a groove and a hinged coupling plate mounted on said gaiter having a rib-shaped projection, which fits said groove.

8. A skiing boot according to claim 2, characterized in that said releasable coupling means includes a spring-loaded coupling plate being hinged to said gaiter and being adapted to be swung in between legs of said slider and to be releasably locked to said slider at least in the coupling position.

9. A skiing boot according to claim 5, characterized in that said adjusting nut carries a scale and a mark on an upper leg of said slider is associated with said scale.

* * * * *